US011072484B1

(12) United States Patent
Silva

(10) Patent No.: US 11,072,484 B1
(45) Date of Patent: Jul. 27, 2021

(54) PORTABLE COOLER

(71) Applicant: Reuben Silva, Center Point, TX (US)

(72) Inventor: Reuben Silva, Center Point, TX (US)

( * ) Notice: Subject to any disclaimer, the term of this patent is extended or adjusted under 35 U.S.C. 154(b) by 122 days.

(21) Appl. No.: 16/549,664

(22) Filed: Aug. 23, 2019

(51) Int. Cl.

| | |
|---|---|
| ***B65D 81/38*** | (2006.01) |
| ***B65D 43/16*** | (2006.01) |
| ***B65D 53/00*** | (2006.01) |
| *F25D 3/08* | (2006.01) |

(52) U.S. Cl.
CPC ..... *B65D 81/3818* (2013.01); *B65D 43/16* (2013.01); *B65D 53/00* (2013.01); *B65D 81/3823* (2013.01); *F25D 3/08* (2013.01)

(58) Field of Classification Search
CPC ..... B65D 81/3886; B65D 81/3818; B65D 81/3813; B65D 81/3823; B65D 81/38; B65D 43/16; B65D 53/00; B65D 1/40; F25D 3/08; F25D 3/06; A45C 11/20
USPC ..... 220/592.21, 592.24, 592.26, 592.2, 506, 220/62.18, 592.11, 592.09, 592.03, 220/592.02, 915.2, 915.1; 62/457.7, 62/457.9, 457.1
See application file for complete search history.

(56) References Cited

U.S. PATENT DOCUMENTS 907,099 A * 12/1908 Trowbridge ..... A23G 9/227 220/592.14
1,993,730 A * 3/1935 Carpenter ..... F25D 23/062 220/592.26
2,036,429 A * 4/1936 Moody ..... F25D 23/06 217/128
4,573,581 A * 3/1986 Galloway ..... A61J 1/165 206/37
5,048,734 A * 9/1991 Long ..... B65D 81/3886 224/148.3
5,706,969 A * 1/1998 Yamada ..... A47J 41/0072 206/522
6,073,796 A * 6/2000 Mogil ..... A45F 3/16 215/12.1
6,244,458 B1 * 6/2001 Frysinger ..... B65D 81/3823 220/592.09

* cited by examiner

*Primary Examiner* — Robert J Hicks
(74) *Attorney, Agent, or Firm* — Gulf Coast Intellectual Property Group

(57) ABSTRACT

A portable cooler configured to have an outer housing and an inner compartment disposed in the interior volume of the outer housing. A void is present intermediate the outer housing and the inner compartment. An insulating sheet material comprised of a first layer and a second layer is circumferentially disposed around the inner compartment within the void. The insulating material is wound around the inner compartment at least twice and includes a void intermediate each wound. The insulating material first layer is manufactured from aluminum faced ceramic cloth and the second layer of the insulating material is manufactured from a flexible mica sheet. The insulating material has a first end secured to an inner surface of the outer housing and a second end secured to an outer surface of the inner compartment. The cooler further includes a hingedly mounted lid.

15 Claims, 2 Drawing Sheets

PORTABLE COOLER

FIELD OF THE INVENTION

The present invention relates generally to coolers, more specifically but not by way of limitation a portable cooler having an inner compartment disposed within an outer compartment wherein a void is present therebetween and further disposed within the void is a wrap formation of insulating material.

BACKGROUND

In the United States millions of individuals utilize portable coolers for various events. Portable coolers are provided in numerous shapes and sizes and are utilized for picnics, going to the beach, fishing and countless other activities. Various styles of coolers are available with the two most common types being a bag cooler wherein the cooler is manufactured from a flexible bag-like material and a rigid cooler. The latter type of cooler is conventionally manufactured from a durable outer shell formed from materials such as but not limited to plastic. Rigid coolers have a void that is filled with a spray foam type of insulation wherein the foam insulation is operable to maintain the interior volume of the cooler at a temperature that is cooler than that of the surrounding environment. Various commercially available coolers provide the foam insulation in different thicknesses so as to provide improved thermal retention.

One issue with conventional spray foam insulation utilized in coolers is the thermal retention properties of the foam insulation. If a cooler is required for use and has been stored in a garage that is very warm, the foam insulation and as such the cooler is at a temperature that will have a negative impact on the initial performance of the cooler. With the cooler temperature being generally equivalent to the external temperature, the cooler must be initially cooled down in order to achieve optimum performance of the cooler as a result of the foam insulation temperature retention properties. Another issue with commercially available coolers is weight. Larger rigid coolers can be quite heavy and as such burdensome to move often requiring more than one person.

Accordingly, there is a need for a portable cooler that provides improved thermal isolation wherein the cooler is lighter in weight and utilizes an insulating material and configuration thereof that provides improved performance.

SUMMARY OF THE INVENTION

It is the object of the present invention to provide a portable cooler that is configured to provide thermal isolation of the interior volume thereof wherein the portable cooler of the present invention includes an outer housing manufactured from a rigid material.

Another object of the present invention is to provide a cooler configured to maintain a temperature within the interior volume thereof that is dissimilar to the environment wherein the outer housing includes an inner compartment disposed therein.

A further object of the present invention is to provide a portable cooler that is configured to provide thermal isolation of the interior volume thereof wherein the outer housing and the inner compartment have a void therebetween.

Still another object of the present invention is to provide a cooler configured to maintain a temperature within the interior volume thereof that is dissimilar to the environment wherein an insulating material is disposed in the void intermediate the outer housing and inner compartment.

An additional object of the present invention is to provide a portable cooler that is configured to provide thermal isolation of the interior volume thereof wherein the preferred embodiment of the insulating material is a flexible material comprised of a first layer and a second layer.

Yet a further object of the present invention is to provide a cooler configured to maintain a temperature within the interior volume thereof that is dissimilar to the environment wherein the insulating material is mounted within the void intermediate the outer housing and inner compartment in a wrap configuration.

Another object of the present invention is to provide a portable cooler that is configured to provide thermal isolation of the interior volume thereof wherein the preferred embodiment of the insulating material includes a first layer of aluminum faced ceramic fiber cloth.

Still an additional object of the present invention is to provide a cooler configured to maintain a temperature within the interior volume thereof that is dissimilar to the environment wherein the second layer of the insulating material is a flexible mica composite sheet material.

An alternative object of the present invention is to provide a portable cooler that is configured to provide thermal isolation of the interior volume thereof wherein the insulating material is wound around the inner compartment and includes voids intermediate each wound of insulating material.

An additional object of the present invention is to provide a cooler configured to maintain a temperature within the interior volume thereof that is dissimilar to the environment wherein the cooler is provided in alternate sizes.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
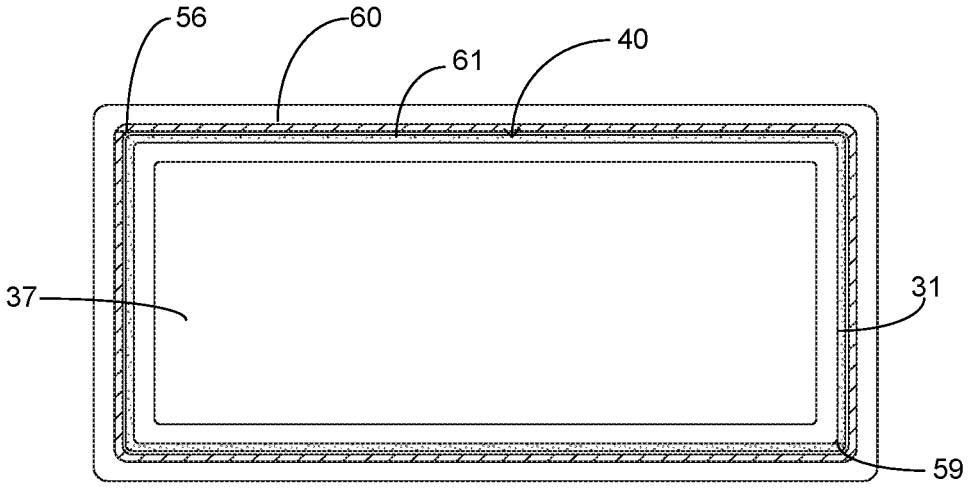
FIG. 1 is a top cross-sectional view of the present invention.
Figure 2:
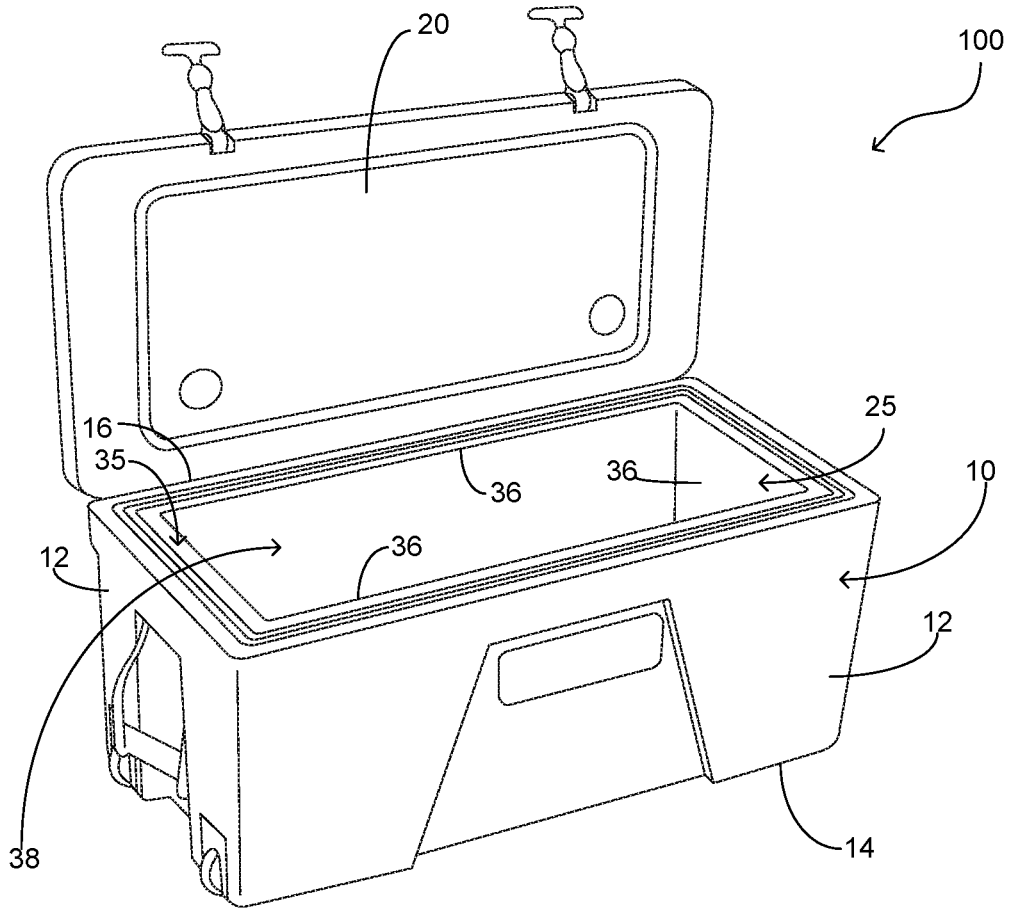
FIG. 2 is perspective view of the present invention.

Referring now to the drawings submitted herewith, wherein various elements depicted therein are not necessarily drawn to scale and wherein through the views and figures like elements are referenced with identical reference numerals, there is illustrated a portable cooler 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular the Figures submitted as a part hereof, the portable cooler 100 includes an outer housing 10 comprised of a plurality of walls 12 and a bottom 14 integrally formed to create an interior volume. The outer housing 10 is manufactured from a suitable durable material such as but not limited to plastic. Hingedly secured to the rear wall 16 of the outer housing 10 is the lid 20. The lid 20 is manufactured from a suitable durable material such as but not limited to plastic and is hingedly secured utilizing suitable hinge fasteners (not particularly illustrated herein). The lid 20 is of suitable size so as to completely cover the opening 25. It should be understood within the scope of the present invention that the lid 20 includes disposed therein the insulating material 50 further discussed herein. It is contemplated within the scope of the present invention that the portable cooler 100 could be provided in various alternate sizes and/or shapes.

Disposed within the interior volume of the outer housing 10 is the inner compartment 35. The inner compartment 35 includes a plurality of walls 36 and a bottom 37 integrally formed to create an interior volume 38. The interior volume 38 of the inner compartment 35 is configured to receive articles therein for storage such as but not limited to food, beverages and ice. While not illustrated herein, it is contemplated within the scope of the present invention that the inner compartment 35 could include objects such as but not limited to storage racks configured to receive objects thereon and maintain in a desired position.

Figure 3:
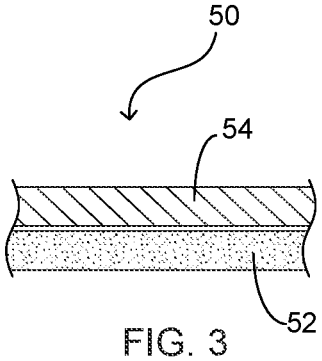
FIG. 3 is a cross sectional view of the insulating material of the present invention.

Intermediate the walls 12 of the outer housing 10 and the walls 36 of the inner compartment 35 is a void 40. The void 40 is uniform in width and is circumferentially present around inner compartment 35. Disposed in the void 40 is insulating material 50. The insulating material 50 is configured to provide thermal insulation for the interior volume 38 of the inner compartment 35 so as to maintain a temperature that is cooler than the environmental surroundings of the portable cooler 100. The insulating material 50 is planar and formed in a sheet wherein the insulating material is flexible. As shown herein in FIG. 3, the insulating material is comprised of a first layer 52 and a second layer 54. The first layer 52 and second layer 54 are joined utilizing suitable durable techniques such as but not limited to chemical adhesion. The first layer 52 of the insulating material 50 in a preferred embodiment is manufactured from an aluminum faced ceramic fiber cloth. The second layer 54 of the insulating material 50 is manufactured from a flexible mica composite sheet. While no particular thickness of the first layer 52 is required, good results have been achieved utilizing a first layer 52 that is approximately one quarter to one half inch in thickness. Additionally, while no particular thickness for the second layer 54 is required, good results have been achieved utilizing a thickness that is approximately ten millimeters. As is further discussed herein, the insulating material 50 is disposed within the void 40 in a wrap configuration wherein the insulating material is wound around the inner compartment 35 at least two times. It should be understood within the scope of the present invention that the insulating material could be wound around the inner compartment 35 in alternate quantities. Furthermore, while a specific material has been identified herein for the first layer 52 and second layer 54 of the insulating material 50, it should be understood within the scope of the present invention that the first layer 52 and second layer 54 could be manufactured from alternate suitable materials.

As is illustrated herein in FIG. 1, the insulating material 50 includes a first end 56 that is operably coupled to the inner surface 9 of a wall 12 of the outer housing 10. The first end 56 is operably coupled utilizing suitable durable techniques such as but not limited to chemical adhesion. The insulating material 50 is circumferentially mounted to the inner compartment 35 so as to create a wrapping style of configuration. Each complete wrap of the inner compartment 35 is defined herein as a wound 60. Each wound 60 includes a small void 61 intermediate an adjacent wound 60. The second end 59 of the insulating material 50 is secured to the outer surface 31 of the wall 36 of the inner compartment 35. The winding configuration of the sheet of insulating material 50 with the termination of the first end 56 and second end 59 thereof, in conjunction with voids 61, achieves a directional result on air present within the void 40. The wrap configuration of the insulating material 50 having the voids 61 intermediate each adjacent wound 60 causes the air to fill the voids 61 and will subsequently be trapped therein. The insulating material 50 then inhibits penetration of air thereinto so as to effectively trap and ensure a temperature within the inner compartment 35 that is lower than that of its external surroundings.

Figure 4:
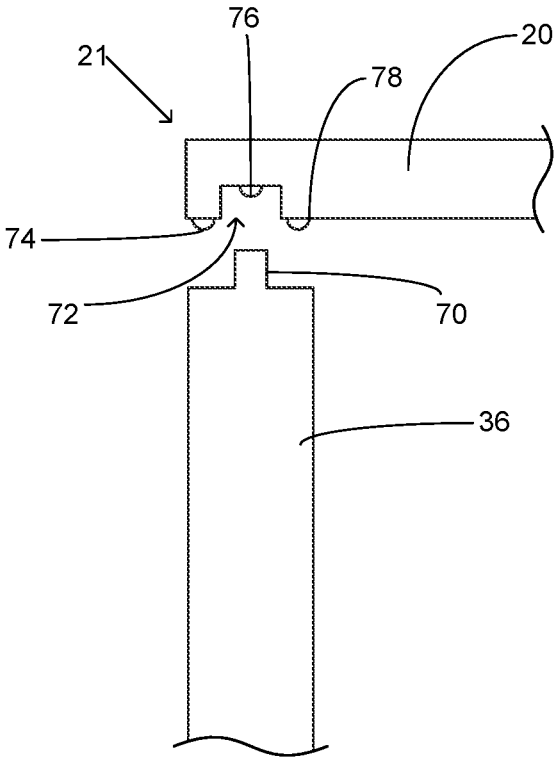
FIG. 4 is a cross-sectional view of the lid and wall of the present invention.

Now referring in particular to FIG. 4, a cross-sectional of the preferred embodiment of the lid 20 and walls 36 is illustrated therein. As is known in the art temperature loss for conventional coolers is significantly contributed to the lid. The preferred embodiment of the present invention provides a configuration to reduce temperature loss from the lid 20 as it egresses from the inner compartment 35. Proximate outer edge 21 the lid 20 has formed therein a groove 72. Groove 72 is configured in a shape to mateably couple with projection member 70. Both groove 72 and projection member 70 are integrally formed in the portable cooler 100 utilizing suitable durable techniques. Ensuing the lid 20 being moved to a closed position, the projection member 72 is substantially disposed within the groove 72. A first sealing member 74 is disposed proximate the external edge of the projection member 70. A second sealing member 74 is superposed the top of the projection member 70 and a third sealing member 76 is adjacent the internal surface of the projection member 70 when the lid 20 is in its closed position. The aforementioned configuration inhibits transfer of temperature from the inner compartment 35. While the groove 72 and projection member 70 are illustrated herein as being a particular shape, it is contemplated within the scope of the present invention that the groove 72 and projection member 70 could be formed in alternate mateable shapes.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable cooler comprising:

an outer housing, said outer housing including at least one wall and a bottom forming an interior volume;

an inner compartment, said inner compartment including at least one wall and a bottom integrally formed to create an interior volume, said inner compartment being disposed within the interior volume of the outer housing;

a void, said void being intermediate said outer housing and said inner compartment; and an insulating material, said insulating material having a first layer and a second layer, said insulating material formed in a sheet, said insulating material being circumferentially disposed around said inner compartment and within said void intermediate said inner compartment and said outer housing and wherein said first layer of said insulating material is aluminum faced ceramic cloth.

2. The portable cooler as recited in claim 1, wherein said second layer of said insulating material is flexible mica composite sheet material.

3. The portable cooler as recited in claim 2, wherein said insulating material includes a first end and a second end and wherein said insulating material encircles the inner compartment at least one time.

4. The portable cooler as recited in claim 3, wherein said first layer is manufactured of a thickness within the range of one quarter to one half inch.

5. The portable cooler as recited in claim 4, wherein the outer housing further includes a projection member extending upward therefrom, said projection member configured to mateably couple with a groove formed on a lid of the portable cooler.

6. A portable cooler configured to maintain a temperature that is less than that of its external surroundings comprising:

an outer housing, said outer housing being manufactured from a rigid material, said outer housing including a plurality of walls and a bottom forming an interior volume;

an inner compartment, said inner compartment being manufactured from a rigid material, said inner compartment including a plurality of walls and a bottom integrally formed to create an interior volume, said inner compartment being formed in a shape identical to that of the outer housing, said inner compartment being disposed within the interior volume of the outer housing;

a void, said void being intermediate said outer housing and said inner compartment; and an insulating material, said insulating material being formed in a flexible sheet, said insulating material having a first end and a second end, said insulating material having a first layer and a second layer, said first layer and said second layer being operably coupled, said insulating material being wrapped around said inner compartment and within said void intermediate said inner compartment and said outer housing wherein the insulating material is present around the inner compartment having at least two wounds therearound.

7. The portable cooler as recited in claim 6, wherein the first end of the insulating material is secured to an inner surface of the outer housing.

8. The portable cooler as recited in claim 7, wherein the second end of the insulating material is secured to an outer surface of one of the plurality of walls of the inner compartment.

9. The portable cooler as recited in claim 8, wherein the at least two wounds include a void intermediate thereto.

10. The portable cooler as recited in claim 9, wherein said first layer is manufactured of a thickness within the range of one quarter to one half inch.

11. The portable cooler as recited in claim 10, wherein said second layer is approximately ten millimeters in thickness.

12. The portable cooler as recited in claim 11, wherein said second layer of said insulating material is flexible mica composite sheet material.

13. The portable cooler as recited in claim 12, wherein said first layer of said insulating material is aluminum faced ceramic cloth.

14. The portable cooler as recited in claim 13, wherein said first layer and said second layer of said insulating material are bound together with chemical adhesion.

15. A portable cooler configured to maintain a temperature that is less than that of its external surroundings comprising:

an outer housing, said outer housing being manufactured from a rigid material, said outer housing including a plurality of walls and a bottom forming an interior volume, said plurality of walls having a projection member formed on an upper surface thereof, said projection member configured to extend upward from the plurality of walls;

an inner compartment, said inner compartment being manufactured from a rigid material, said inner compartment including a plurality of walls and a bottom integrally formed to create an interior volume, said inner compartment being formed in a shape identical to that of the outer housing, said inner compartment being disposed within the interior volume of the outer housing;

a void, said void being intermediate said outer housing and said inner compartment;

an insulating material, said insulating material being formed in a flexible sheet, said insulating material having a first end and a second end, said insulating material having a first layer and a second layer, said first layer and said second layer being operably coupled, said insulating material being wrapped around said inner compartment and within said void intermediate said inner compartment and said outer housing wherein the insulating material is present around the inner compartment having at least two wounds therearound; and a lid, said lid being hingedly coupled to said outer housing, said lid movable intermediate a closed position and an open position, said lid having a groove formed in a bottom surface thereof, said groove configured to mateably couple with said projection member when said lid is in said closed position, said lid further including a first sealing member, said first sealing member positioned to be adjacent an externally facing surface of said projection member, said lid having a second sealing member, said second sealing member being adjacent a top surface of said projection member when said lid is in said closed position, said lid further including a third sealing member, said third sealing member being adjacent an inward facing surface of said projection member.

* * * * *